US007794172B2

(12) United States Patent
Winkler et al.

(10) Patent No.: US 7,794,172 B2
(45) Date of Patent: Sep. 14, 2010

(54) PERIMETER ANTI-RAM SYSTEM

(76) Inventors: Gregory Robert Winkler, 13971 Quail Ridge Dr., Broomfield, CO (US) 80020; Reginald John Kerr, 9850 N. Shore Rd., Cuba, NY (US) 14727

( * ) Notice: Subject to any disclaimer, the term of this patent is extended or adjusted under 35 U.S.C. 154(b) by 364 days.

(21) Appl. No.: 11/877,237

(22) Filed: Oct. 23, 2007

(65) Prior Publication Data

US 2008/0131200 A1 Jun. 5, 2008

Related U.S. Application Data

(60) Provisional application No. 60/862,737, filed on Oct. 24, 2006.

(51) Int. Cl.
*E01F 13/00* (2006.01)
*E01F 9/00* (2006.01)

(52) U.S. Cl. ..... 404/6; 404/9

(58) Field of Classification Search ..... 404/6, 404/9; 49/9

See application file for complete search history.

(56) References Cited

U.S. PATENT DOCUMENTS

| | | | | |
|---|---|---|---|---|
| 16,419 | A * | 1/1857 | Wickersham | 256/70 |
| 1,315,320 | A * | 9/1919 | Mesurier | 244/110 R |
| 2,450,328 | A * | 9/1948 | Cotton | 244/110 R |
| 4,554,695 | A | 11/1985 | Rowland | |
| 4,647,246 | A | 3/1987 | Brink et al. | |
| 4,723,759 | A * | 2/1988 | Patrick | 256/22 |
| 4,730,810 | A * | 3/1988 | Rambaud | 256/12.5 |
| 4,748,766 | A | 6/1988 | Stimac | |
| 4,752,152 | A | 6/1988 | Crisp et al. | |
| 4,780,020 | A | 10/1988 | Terio | |
| 4,819,915 | A * | 4/1989 | Cargnel | 256/12.5 |
| 5,961,099 | A * | 10/1999 | Thommen, Jr. | 256/12.5 |
| 6,382,869 | B1 | 5/2002 | Dickinson | |
| 6,679,649 | B1 * | 1/2004 | Capolupo | 404/6 |
| 6,811,144 | B2 | 11/2004 | Denman et al. | |
| 7,214,000 | B2 | 5/2007 | Marsh et al. | |
| 7,325,788 | B1 * | 2/2008 | Stanek et al. | 256/13.1 |
| 7,398,960 | B2 * | 7/2008 | Neusch | 256/47 |
| 7,466,228 | B2 * | 12/2008 | Wong | 340/541 |
| 7,475,868 | B1 * | 1/2009 | Gibbs | 256/23 |
| 7,556,243 | B2 * | 7/2009 | Williams | 256/13.1 |
| 7,604,430 | B2 * | 10/2009 | Pervan | 404/6 |
| 2004/0228683 | A9 | 11/2004 | Gelfand et al. | |
| 2006/0202182 | A1 | 9/2006 | Bergendahl et al. | |
| 2007/0077118 | A1 * | 4/2007 | Mahal et al. | 404/6 |
| 2008/0230759 | A1 * | 9/2008 | Lass et al. | 256/13.1 |

* cited by examiner

*Primary Examiner*—Thomas B Will
*Assistant Examiner*—Abigail A Risic
(74) *Attorney, Agent, or Firm*—Marsh Fischmann & Breyfogle LLP

(57) ABSTRACT

Disclosed herein are passive and active vehicle arresting barrier systems that may be combined to provide anti-ram protection along an entire perimeter of a secured area including vehicle access points. A perimeter fence portion is a passive barrier system that stops an attacking vehicle within a predetermined penetration distance and may blend into an existing perimeter fence structure to provide an architecturally hidden structure. The access opening portion utilizes a collapsible road deck and an underlying pit that does not require hydraulic or electrical means to deploy.

10 Claims, 9 Drawing Sheets

PERIMETER ANTI-RAM SYSTEM

CROSS REFERENCE TO RELATED APPLICATION

This application claims the benefit of U.S. Provisional Application No. 60/862,737 entitled "Anti-Ram Gate Gravity Drop System," having a filing date of Oct. 24, 2006, the entire contents of which are incorporated herein by reference.

FIELD OF THE INVENTION

The present invention relates to systems and methods (utilities) for protecting a perimeter of a secured area from unauthorized vehicle access. More specifically, a passive fencing system is provided for preventing vehicle entry through sections of the secured perimeter between access openings. An active system is provided for securing access openings (e.g., gates).

BACKGROUND OF THE INVENTION

Existing, passive vehicle barrier systems typically consist of massive concrete structures that provide the stopping effect to intruding vehicles through pure mass. The concrete structures are necessarily large and occupy significant real estate. These structures are often architecturally unsightly and expensive when used to protect large perimeters. When such barriers are used at access gate openings, they can provide a maze through which forces the vehicle to slow down. However, the barriers do not physically stop the vehicle—they only delay its arrival.

Other vehicle arresting barriers utilizing steel cable arrestor means are used as median barriers along roads and highways, however these barriers are design to deflect vehicles following an impact at an angle to the barrier or "fence" line. These systems are not designed to resist a head-on collision. Further, the Army Corps of Engineers have deployed systems that utilize steel cables stretched between buried concrete "dead-man anchors" around a protected area. These systems are not designed for any specific impact and normally allow the vehicle to intrude a significant distance into the protected area before the vehicle is finally stopped.

The existing concrete and or cable systems only protect the fenced portion of the perimeter and do nothing to secure gate openings. Existing gates are often protected by vehicle intrusion prevention systems that utilize hidden bollards or angled steel plates that are raised into their vehicle stopping position by hydraulic, electrical or other means. Other gate opening protection systems use hardened gates that are required to be rolled into position before an intruding vehicle arrives. These normally hidden, power actuated active systems need to first detect the vehicle attack and then deploy in a timely fashion. Due to the possibility of power or detection failure, these systems do not provide the absolute protection afforded by a passive barrier system. Further, it is known that following activation and stopping of an attacking vehicle, that these existing systems are often so badly damaged that total replacement is required to bring the device back into service.

SUMMARY OF THE INVENTION

Disclosed herein are passive and active vehicle arresting barrier systems that may be combined to provide anti-ram protection along an entire perimeter fence line including vehicle access points. However, it will be appreciated that the components (e.g., active and passive) of the overall system are considered novel alone as well as in combination. The perimeter fence portion is a passive barrier system that stops an attacking vehicle within a predetermined penetration distance and may blend into an existing perimeter fence structure to provide an architecturally hidden structure. The access opening portion utilizes a collapsible road deck and an underlying pit that does not require hydraulic or electrical means to deploy.

In one arrangement, sides of a gate opening utilizing the collapsible road deck may be abutted by the ends of sections of the fence portion of the system. The collapsible road deck may provide an architecturally hidden structure that presents the appearance of a flat road section. An end wall of the underlying pit may be constructed such that it remains undamaged during. In this regard, following activation (e.g., collapse of the road deck) a vehicle may fall into the pit and impact the end wall of the pit. The vehicle wreckage may be removed by a typical wrecker or tow truck and the road deck and its triggering mechanism may be quickly reset to be ready for the next attempted intrusion.

In one aspect, a fencing system is provided that may be utilized alone or in an overall perimeter defense system including one or more access points. The fencing system provides intrusion protection against vehicles that may try to ram through the fencing system into a secured area. As presented, each section of the fencing system includes first and second anchor columns that are spaced apart and secured below grade (e.g., within the earth). At least one horizontal cable extends between the anchor columns. Further, the ends of the horizontal cables are affixed to the anchor columns. In this regard, it will be appreciated that the horizontal cable(s) may be stretched between the anchor columns in order to define a fence line. Accordingly, one or more support posts may be disposed between the anchor columns (e.g., along the fence line). Such a support post(s) may support cable(s) above the surface of the earth/ground surface. Additionally, one or more anchor cables are secured below grade (e.g., along the fence line) and have a free end that extends above the grade (e.g., ground surface). This free end is moveably connected to the horizontal cable(s). Further, the horizontal cables may disengage from the support posts upon the cables being impacted. In this regard, when a vehicle contacts one or more of the horizontal cables, the horizontal cables are able to disengage form the support ports and initially slip through the one or more anchor cables. As will be appreciated, this allows for dissipating the force of the impacting vehicle along the entire length of the horizontal cable. This allows for spreading the impact force between the anchor columns as well as one or more anchor cables secured below grade.

It will be appreciated that a plurality of support posts and plurality of anchor cables disposed between each pair of anchor columns. It may be desirable that the distance between the anchor cables be limited. In one arrangement, the distance between any adjacent anchor cables or an anchor cable and an adjacent anchor column does not exceed about 20 feet. Support posts may be equally spaced with the anchor columns. However, it will be appreciated that it may be desirable to have support posts at different (e.g., smaller) intervals.

In one arrangement, each of the support posts may include a horizontal notch (e.g., at a predetermined distance above the ground surface) that is sized to receive and hold one or more horizontal cables at predetermined distances above grade. These notches may be formed such that cables are able to disengage from the support posts upon vehicle impact such that force may be transmitted along the length of horizontal cables, to multiple anchor cables and, hence, the anchor columns.

In one arrangement, each anchor cable is disposed within a support post. In this regard, the support post may include a recessed channel (e.g., vertically disposed) along at least a portion of its height. In this regard, the anchor cables may initially be seated within the recessed channel and may be operative to move out of the recessed channel upon a vehicle impacting the horizontal cable(s). In this regard, one or more of the support posts may each house an anchor cable such that the anchor cable is hidden from view.

The horizontal cables may be disposed within fencing components that extend between, for example, support posts and/or the anchor columns. In one particular arrangement, the horizontal cables may be disposed within vinyl fencing panels that extend between support posts and/or anchor columns. In such an arrangement, the anchor cables may be secured and covered by vertical vinyl fencing components. In such an arrangement, the fencing system may be indistinguishable from a standard vinyl fence.

According to another aspect, a system is provided for arresting the impact of a vehicle attempting to cross a secured perimeter at a gate access point. In this aspect, the system includes a collapsing road deck that prevents unauthorized entry of an intruding vehicle. The system includes a road deck that defines an attack end and a secured end. The attack end of the road deck is pivotally supported while the remainder of the deck is suspended over a pit. Generally, when suspended over the pit the road deck is substantially level with adjacent road surfaces such that it may be architecturally hidden. The system further includes at least one support, typically at least one on each side of the road deck, that are moveable between a support position and a release position. In the support position, the supports maintain the road deck substantially level with the road surface. The system further includes a vehicle barricade disposed proximate to the attack end of the road deck. A mechanical linkage extends between the vehicle barrier and the supports. In this regard, upon a vehicle contacting the vehicle barrier the mechanical linkage may move the supports to the release position such that end of the road deck remote from the vehicle barricade is freed to fall into the pit. In this regard, the system may be activated by an intruding vehicle and subsequently gravity operated.

In one arrangement, the deck includes one or more vents to allow air displacement from the pit during collapse. In a such arrangement, a portion or all of the deck surface may be formed of a grate. In a further arrangement a selectively operable actuator may be utilized to move the support to the release position. In this arrangement, a user may selectively actuate the collapse of the road deck.

In a further arrangement, the size/length of the road deck may be adjusted for anticipated attack speeds. Generally, the length of the deck may be increased to account for higher speeds. Further additional barriers may be utilized to slow and or direct vehicles as they approach the road deck.

The pit may have any necessary depth, which may be a function of the length of the road deck. In one arrangement, the pit is at least five feet deep at the secured end of the road deck. In a further arrangement, the pit may be sloped between the attack end and secured end of the road deck. The end wall of the pit the That is impacted by a vehicle that falls with the road deck into the pit may be reinforced (e.g., concrete) such that is sustains little or no damage upon impact.

DETAILED DESCRIPTION

Reference will now be made to the accompanying drawings, which assist in illustrating the various pertinent features of the present disclosure. Although the present disclosure is described primarily in view with an overall system for protecting a secured perimeter from vehicle instruction, it should be expressly understood that aspects of the present invention may be applicable to other applications. Specifically, the perimeter fencing system that provides a passive vehicle barrier (e.g., passive portion of the system) and the collapsible road deck that provides an active vehicle barrier (e.g., active portion of the system) may be utilized alone or in conjunction. In this regard, the following description is presented for purposes of illustration and description.

Figure 1:
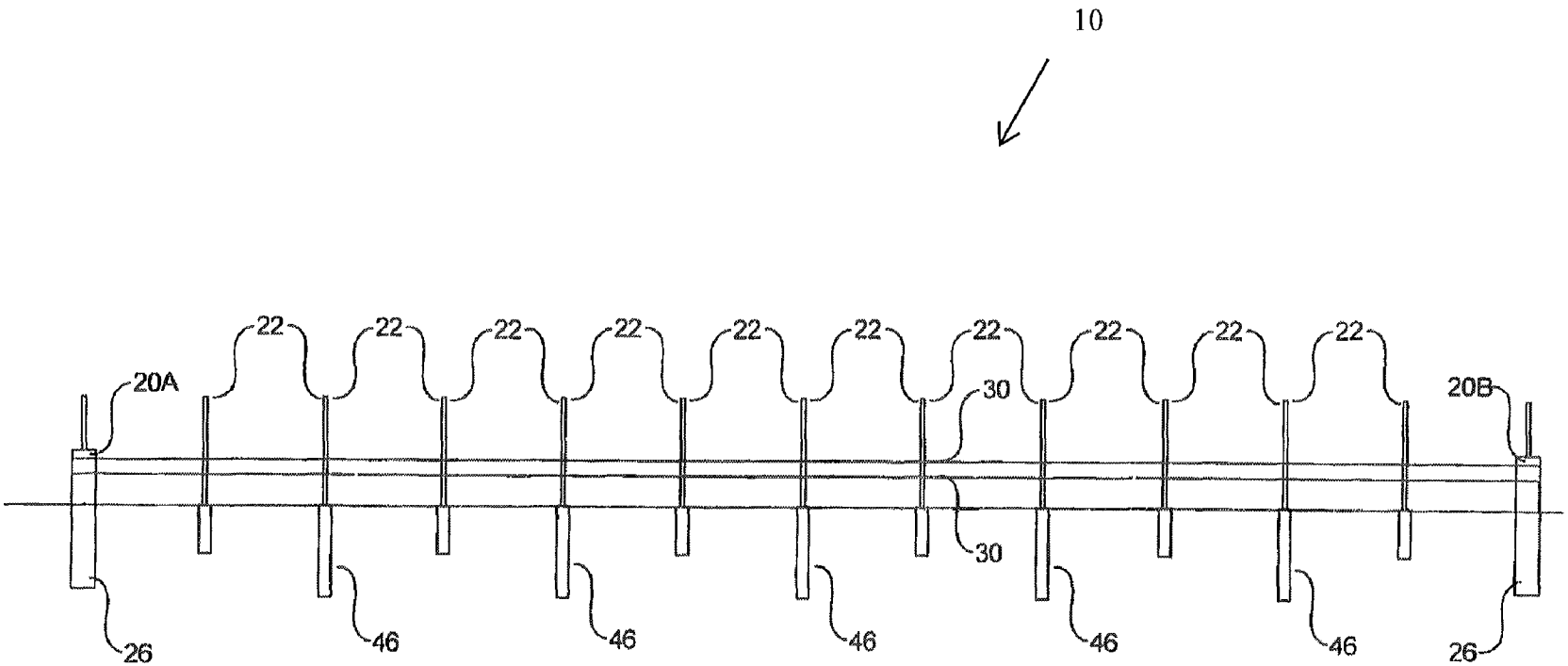
FIG. 1 illustrates a first embodiment of an arresting barrier system.
Figure 2:
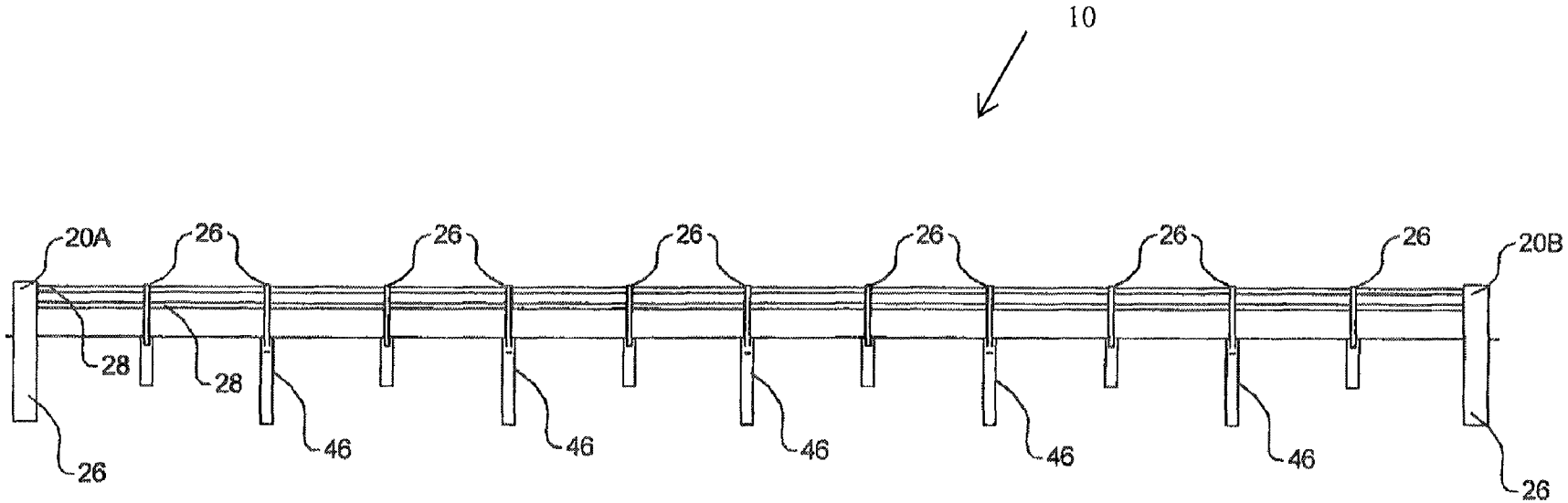
FIG. 2 illustrates a second embodiment of an arresting barrier system.
Figure 8:
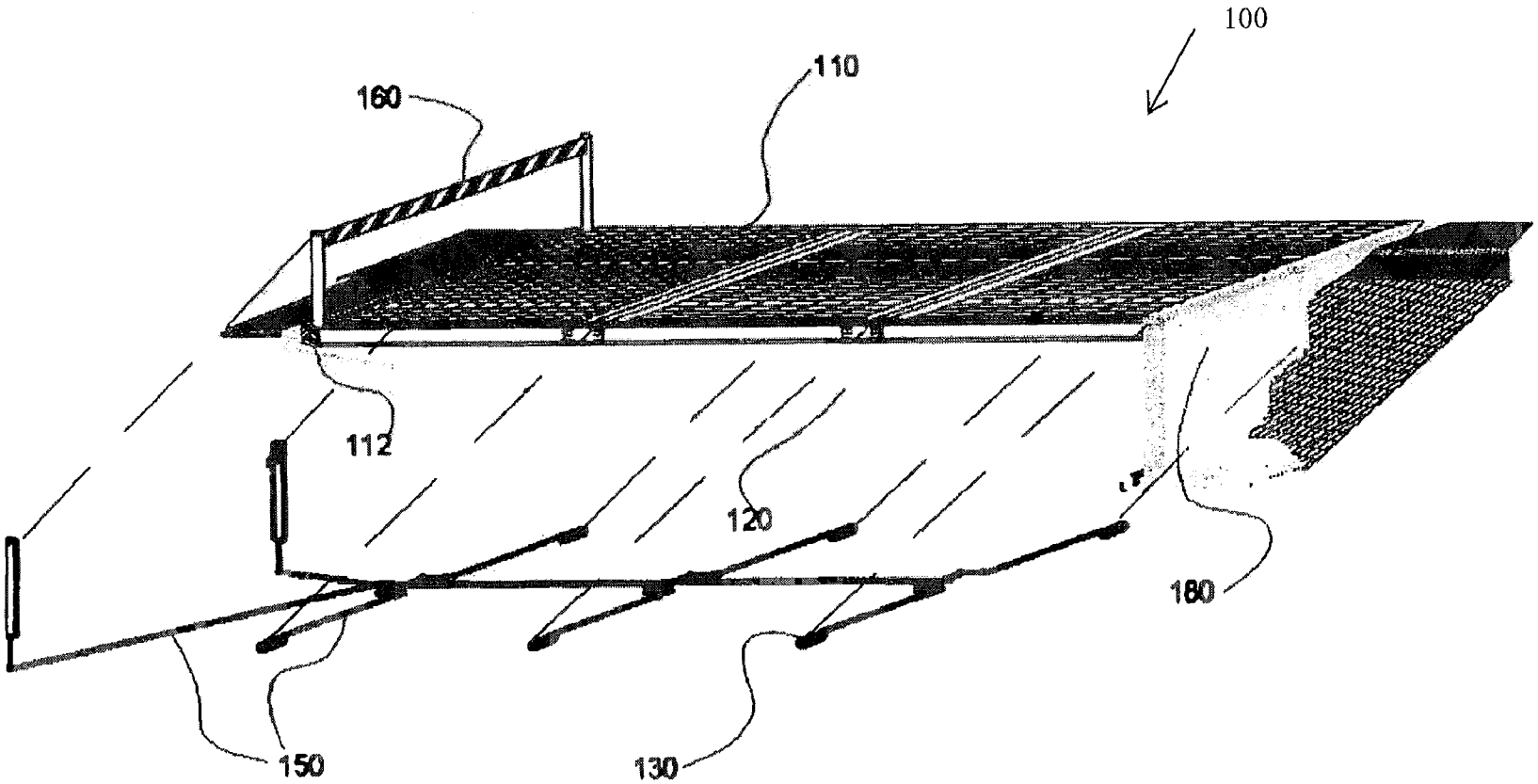
FIG. 8 illustrates a perspective view of a collapsible road deck of an anti-ram gate protection system.
Figure 9:
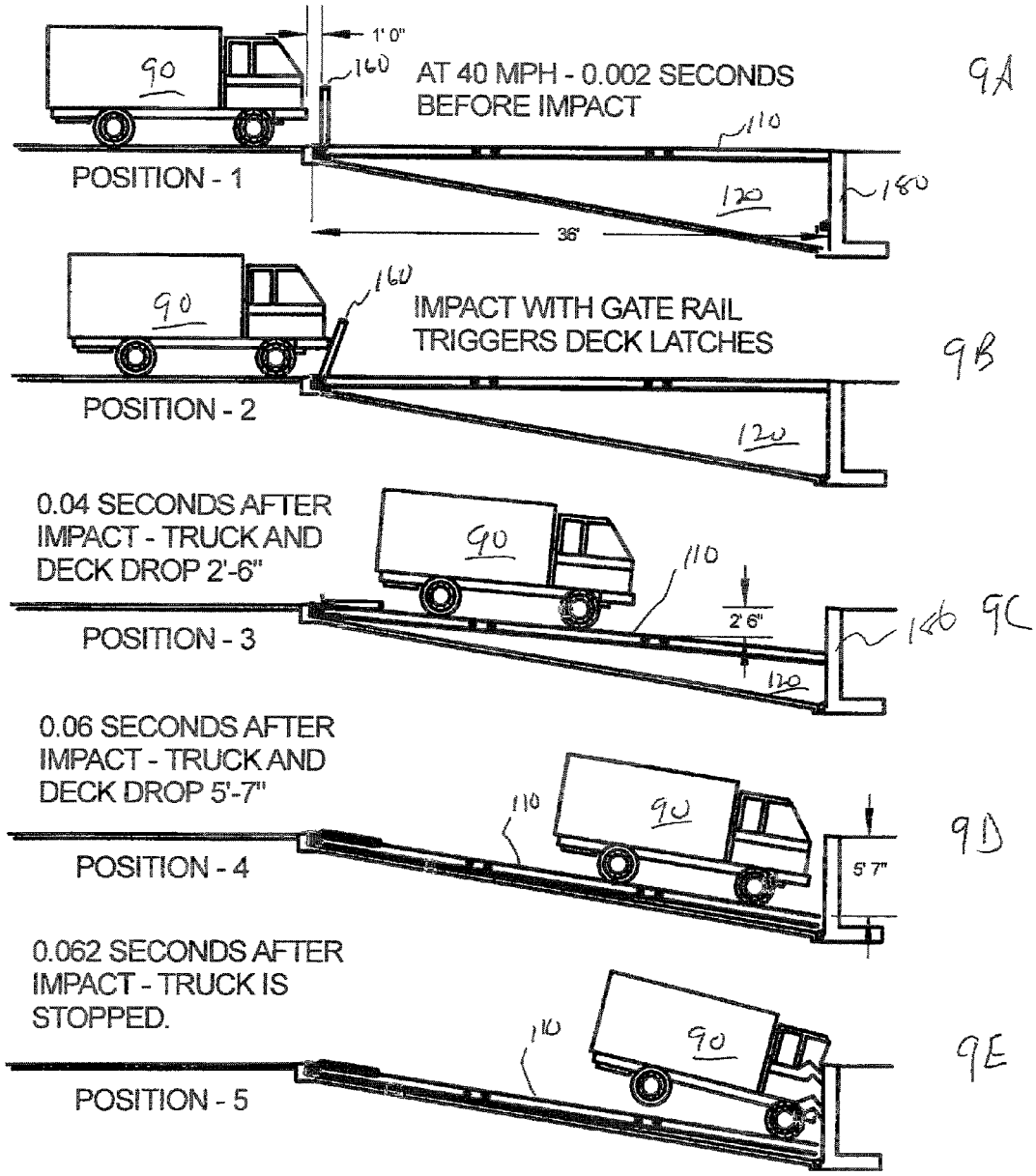
FIG. 9A-9E illustrate truck and deck positions during activation of the anti-ram gate protection system.

The passive portion of the system can either be installed in a stand-alone configuration, see FIG. 1, or architecturally hidden within a variety of perimeter fence systems, see FIG. 2. The gate access point portion of the system (i.e., active portion) described herein is a road level anti-ram system, see FIG. 8, which is mechanically activated by the intruding vehicle. Importantly, the access point portion does not require hydraulic or electrical means to deploy as the system is mechanically activated by the intruding vehicle. Once triggered, the system uses gravity and the mass of the vehicle to achieve the stopping action. In the illustrated embodiment, the access point protection system is an architecturally hidden structure that presents the appearance of a flat road section of, for example, perforated steel plates such as is commonly seen on bridge decks.

The supporting fence systems for the fence portion of the anti-ram protection can range from, but are not limited to, an aesthetically pleasing two rail vinyl fence to a commercial chain link perimeter security fence system installed on/in specially designed channel posts. While the supporting fences provide static support and some protection from unauthorized human access, they are not designed to contribute to the stopping of intruding vehicles by the arrestor cable system.

The vehicle arresting fencing system may be deployed in multiple adjacent sections about a secured perimeter. In one exemplary embodiment, the barrier fencing system is deployed in 100 to 150-foot long sections that may be stand-alone sections or joined to adjacent sections, see FIGS. 1 and 2. Generally, each section the fencing system 10 includes first and second anchor columns 20A and 20B. At least one, and more typically a plurality of horizontal arrestor cables 30 extend between the first and second anchor columns 20A and 20B. The horizontal arrestor cables 30 are generally formed of high tensile steel cables. The ends of the horizontal arrestor cables 30 are terminated (e.g., via tapered "grips") at the anchor columns 20A, 20B. These horizontal arrestor cables 30 may be disposed at different heights.

In order to support the horizontal arrestor cables 30 above the grade (e.g., ground surface) one or more support posts 22 may be disposed between the anchor columns 20A and 20B. In addition, one or more of the support posts 22 may house a vertical restraint cable 40. See FIGS. 3A-3C. In one arrangement, every other support post 22 includes a vertical restraint cable 40. As shown in FIGS. 3B and 3C, free ends of the vertical restraint cables 40 are disposed above grade and slidably connected to the horizontal arrestor cables 30.

In one arrangement, I-beams are utilized for the anchor columns 20A, 20B, however, it will be appreciated that any column that provides a desired anchoring may be utilized. In the illustrated embodiment, the "I"-beams are secured in place by 24-inch diameter concrete foundations 26 cast-in-place into holes drilled in the ground. The depth of the foundations 26 is determined by local ground conditions. However, other suitable means of securing the "I"-beam anchor columns may be used depending upon the existing ground conditions. These may include but are not limited to pile driving the "I"-beam anchors direct into the soil, or using smaller diameter cast-in-place concrete foundations in holes drilled in rock, or larger diameter cast-in-place concrete foundations in loose soil. For architectural purposes, the I-beam anchors may be covered in concrete or other means, or the entire anchor may be manufactured as a pre-cast or cast-in-place reinforced concrete monolithic structure.

Anchor columns 20 may be used at corners, arrestor cable system ends as well as at interfaces with access points (e.g., gates) as well as the ends of each fence section. The anchor column spacing may be determined by site-specific requirements. The horizontal arrestor cables 30 may be secured to the anchor columns using commercially available engineered taper grip devices at each end of each cable as it passes through holes drilled in the anchor.

Figure 3A:
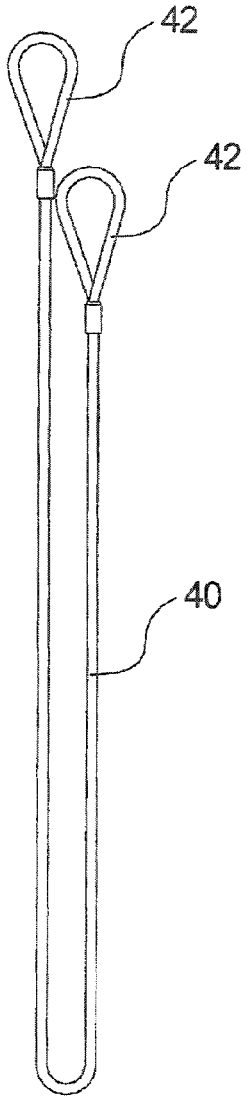
FIG. 3A-3C illustrate anchor cable and support post configurations for use in the embodiments of FIGS. 1 and 2.
Figure 3B:
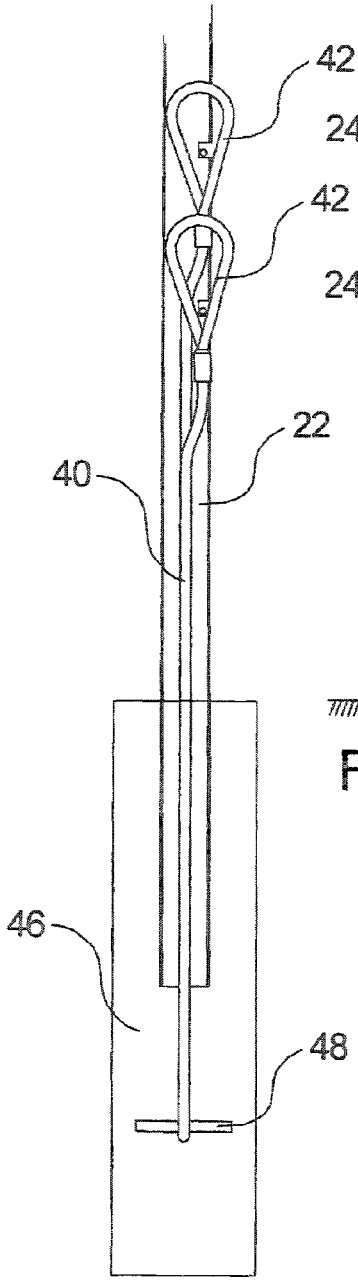
Figure 3C:
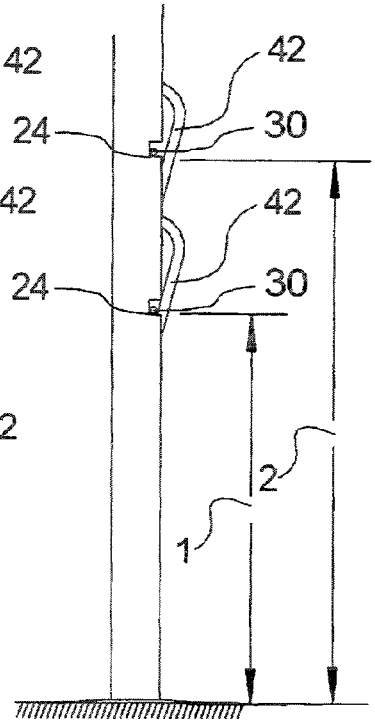
Figure 4:
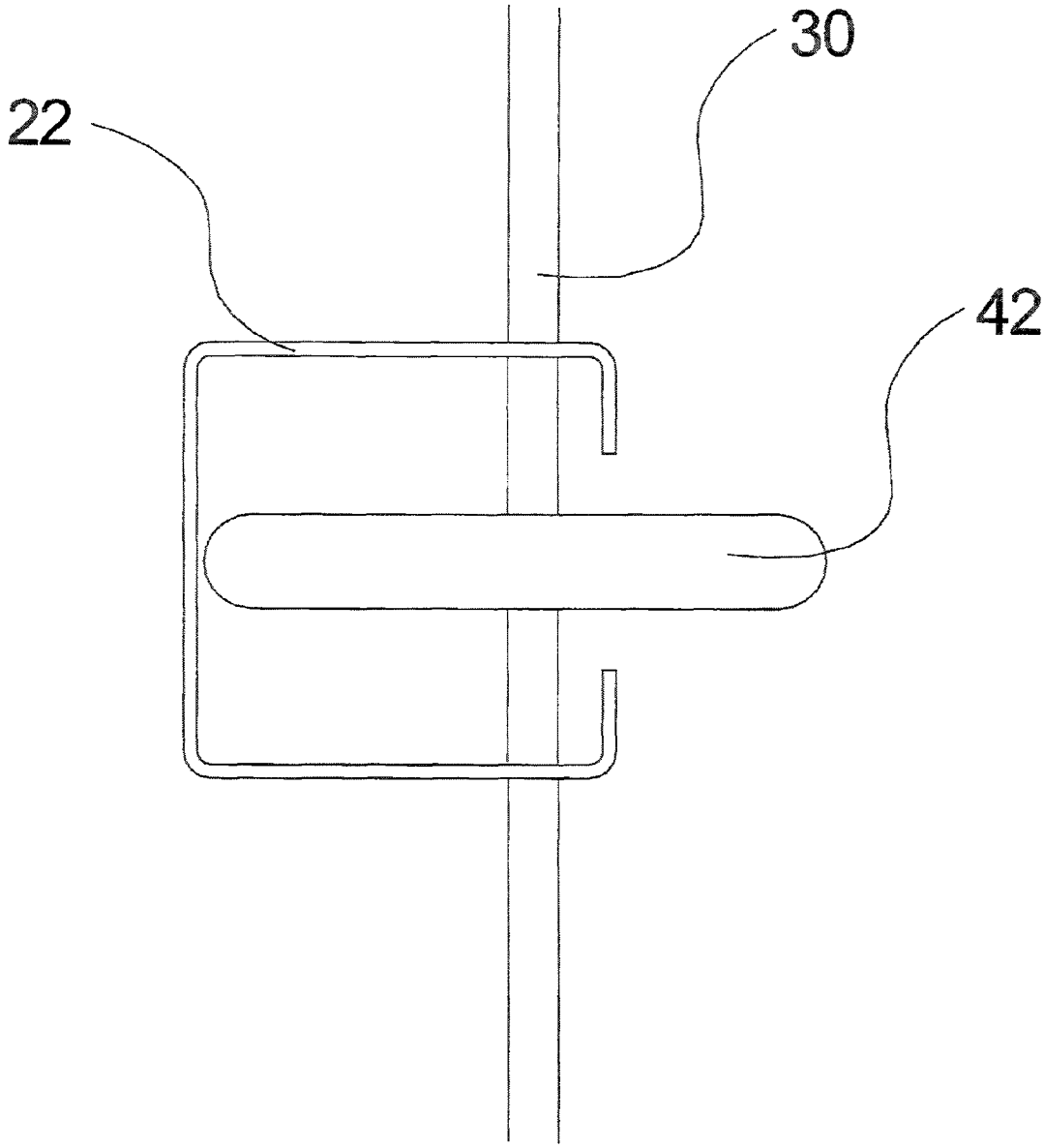
FIG. 4 illustrates a top view of one support post configuration.

The horizontal arrestor cables 30 are disposed through loops 42 formed at the top/free ends of the vertical restraint cables 40, see FIGS. 3A-3C, which as noted are located at intervals along the fence sections. In one embodiment, the vertical restraint cables 40 are located every twenty feet. As shown in FIGS. 1, 2 and 3B, the vertical restraint cables 40 are securely fixed in individual concrete foundations 46 that are typically steel reinforced 48. These foundations 46 may also be used to support fence posts 22 that do not contain vertical anchor cables if desired. Alternatively, fence posts that do not include vertical anchor cables may not include reinforcing steel and/or foundations.

In most applications, support for the horizontal arrestor cables 30 may be provided by notches 24 in the support posts 22, see for example FIG. 3C. Other support systems such as notched vertical angle or channel section steel, aluminum, fiberglass or other suitable material may be used as dictated by local conditions and design requirements.

In one embodiment, which may be utilized with a chain link fence, the support posts 22 that include the vertical restrain cables 40 are channel posts (e.g., "C"-channeled) that are used to house and/or hide the vertical restraint cables 40. In such an embodiment, the vertical restraint cables 40 are housed within open-sided (e.g., channeled) posts. See FIGS. 3D and 5. These "C" channel posts 22 in one particular embodiment, are 4-inch square sections roll formed from 10 gauge steel with a 2-inch wide opening in one side. The open side allows the vertical restraint cables 40 to deflect out of the channels upon impact of a vehicle. As noted, these posts may be supported in concrete foundations that may include metal reinforcement.

The horizontal arrestor cables 30 between the anchor columns 20A, 20B are supported in notches 24 formed into the sides of the channeled support posts 22. Several cables may be supported in each notch 24. As the horizontal arrestor cables 30 pass through the notches in each "C" channel fence post, they also pass through loops 42 in the ends of the vertical restraint cables 40 that are located inside the "C" channel posts. These vertical restraint cables 40 in one exemplary embodiment, are each fabricated from a single ⅝ or ¾ inch diameter IPS industrial wire rope with a loop formed in each end commonly known as a "Flemish Loop". Both loops 42 of each restraint cable 40 are located inside the "C" channel post 22. see FIG. 3C. The ends of the restraint cable may extend above the grade to different heights. The middle portion of the restraint cable 40 between the ends passes down into the concrete post foundation 46 where it is looped around the reinforcement steel 48 in the post foundation.

The restraint cables 40 and the arrestor cables 30 may be restrained from casual displacement from the "C" channel posts by commercial wire ties similar to those used to attach chain link fence fabric to fence posts. During impact by a vehicle such ties break free allowing the horizontal arrestor cables 30 and vertical restraint cable(s) 40 to travel out and away from the recess of the "C" channel support posts with virtually no hindrance.

Figure 5:
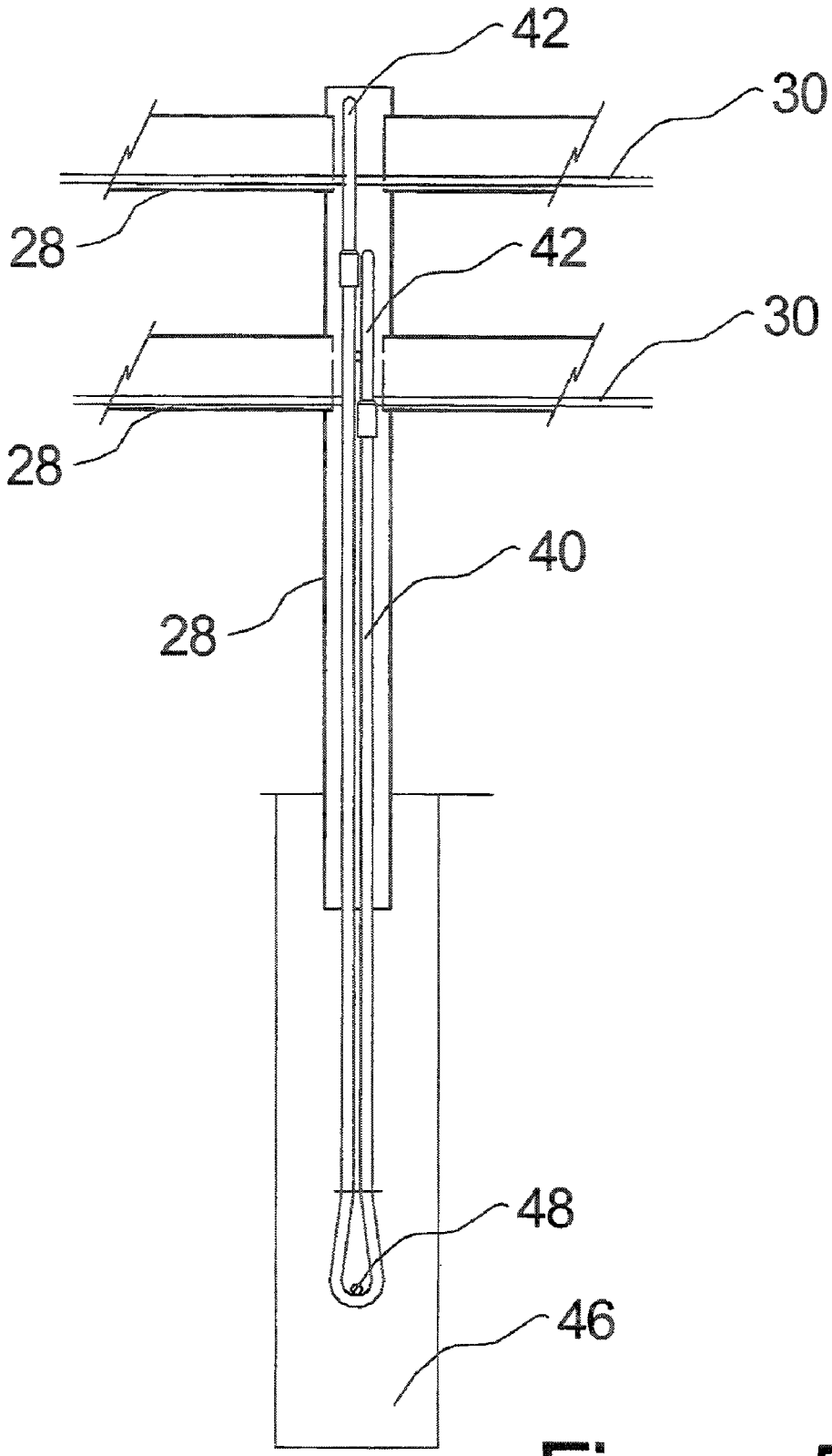
FIG. 5 illustrates implementation of the arresting barrier system into a vinyl fence.

The system can be used with different fencing systems, including a vinyl fence that allows for hiding the arresting component within the fence. See FIG. 5. The vinyl fence including vertical posts, top rails, bottom rails, post caps and all other sundry parts may be industry standard parts and are not considered part of the arrestor system. In this regard, the vinyl fence portion of such a system exists to provide static support for the arrestor cables and restraint cables plus an aesthetic covering for these parts. Generally, the vinyl fence is sacrificial in the event of a vehicle impact and does not contribute to the stopping of the vehicle.

Where the system is incorporated into a vinyl fence, vinyl posts 22 may receive and support the horizontal vinyl rails 28 as well as house a vertical restraint cable 40. see FIGS. 2 and 5. As the horizontal arrestor cables 30 pass through each vinyl fence post 22, they also pass through loops 42 in the ends of the vertical restraint cables 40 that are located in, for example, every second post. When utilizing a vinyl fencing system, hollow vinyl post may be used in place of the channeled posts or vinyl posts may be placed over channeled posts. In any case, the vinyl post are supported in a foundation that provides necessary structural support for the vertical restraint cable 40. At anchor column locations, the above ground portion of the "I"-beam anchor column can be covered to enhance the architectural appearance. The anchor columns are only installed at the ends of the arrestor cables such as corners, beginning and end of the arrestor system and at intervals along the fence line in one exemplary embodiment.

Both the restraint cables 40 and the arrestor cables 30 are restrained from casual displacement and hidden from view by their location inside the horizontal vinyl rails see FIGS. 2 and 5, and the vinyl posts 22. Under impact by a vehicle the vinyl fencing is destroyed allowing the arrestor cables 30 and restraint cables 40 to travel out and away from the point of impact with little or virtually no hindrance and allowing the system to apply resistance to the vehicle motion. Generally, the vinyl fence system is only used to provide demarcation of a perimeter to prevent casual human intrusion and to support the arrestor cables. The vinyl fence does not contribute to the vehicle stopping capability of the arrestor cable system. If required extra rails can be added to the vinyl fence system to accommodate more arrestor cables.

In any embodiment, the number and location of the horizontal arrestor cables 30 is dependent upon the required security level for the perimeter. Generally, more cables may be deployed as the perceived threat becomes larger and or faster. For instance stopping a 3,000-pound vehicle traveling at 30 miles per hour may be accomplished with 4 to 6 cables. Stopping a 15,000-pound vehicle traveling at 50 miles per hour may require 9 to 12 cables. The cables selected for one exemplary embodiment are ½ or ⅝-inch diameter seven strand high tensile steel normally used in reinforced concrete pre-stressed or post-tensioning applications. These cables are readily available and pre-tested to ensure a minimum strength for each manufactured batch and the cables are available in galvanized or vinyl-coated form if environmental conditions require such protection. However, other cables of different construction dimensions and materials such as crane rigging and wire rope may be used if a particular application requires different characteristics.

The length of each arrestor cable section may be designed to limit the distance that the attack vehicle intrudes beyond the perimeter before being stopped. To maintain the stopping distance of the system, the design length is kept consistent in multiples of these design length sections with overlaps between the sections as required to fit the perimeter fence configuration.

Figure 6:
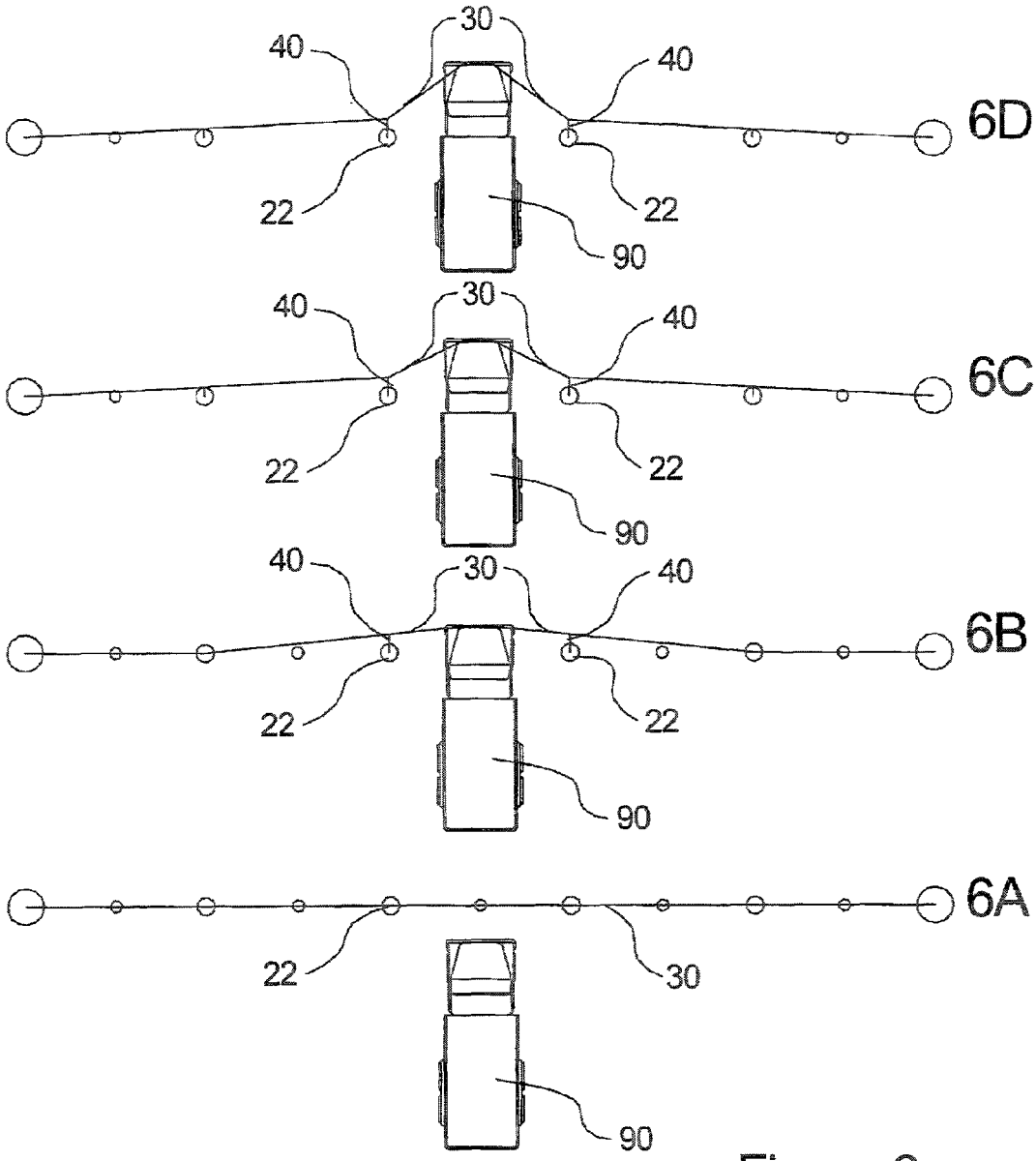
FIG. 6A-6D illustrates a top view of a vehicle striking an arresting barrier system.
Figure 7:
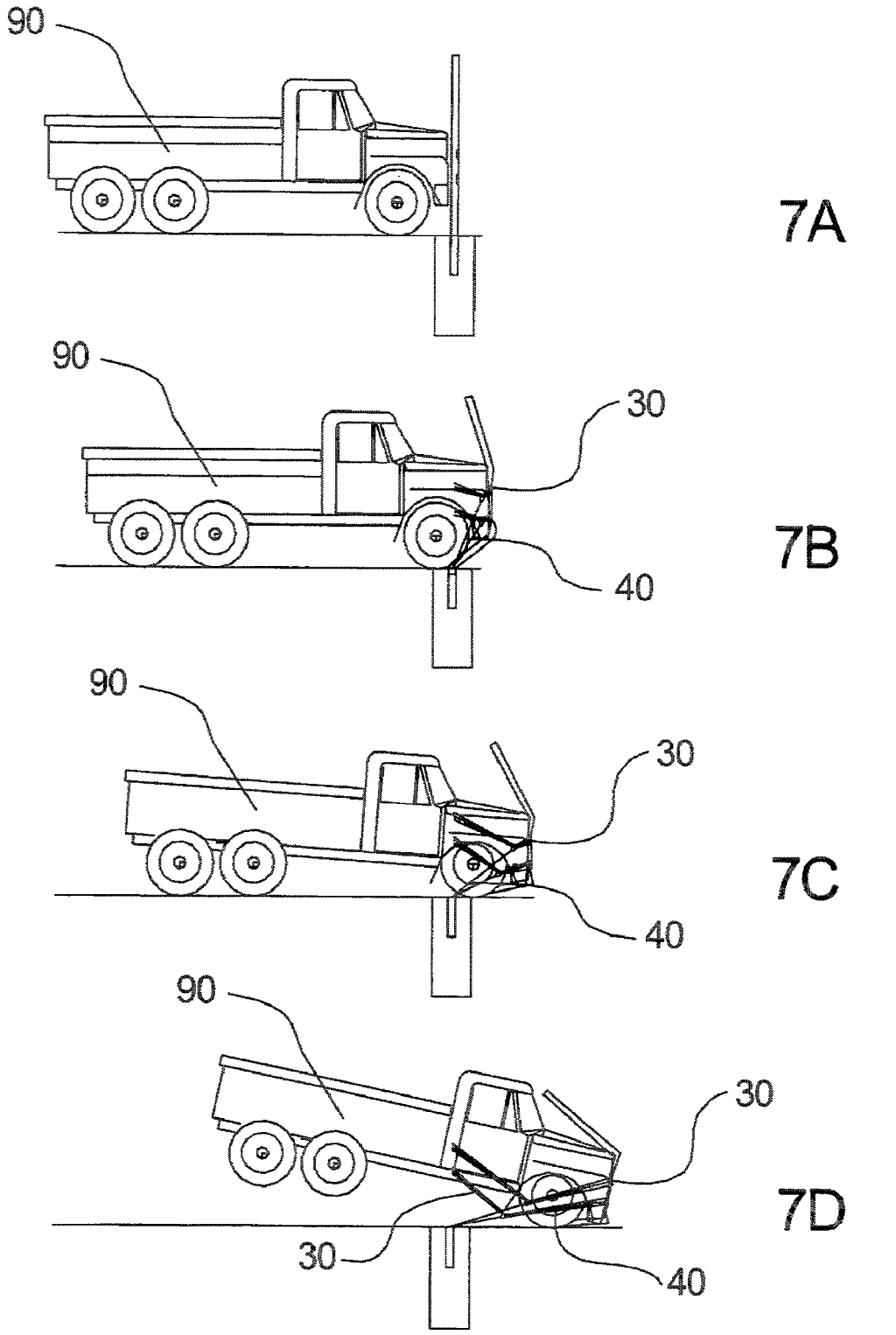
FIG. 7A-7D illustrates a side view of a vehicle striking an arresting barrier system.

When a vehicle 90 initially makes contact with the fence there is very little retardation force applied to the vehicle 90. See FIGS. 6A and 7A. The vehicle 90 deforms the fence (e.g., chain link fabric, or the vinyl posts and rails) and continues on, a few inches past the fence line, where it makes initial contact with the arrestor cables 30. As the vehicle 90 continues moving through the fence line, the arrestor cables begin to wrap around the front of the vehicle 90. See FIGS. 6B and 7B.

The initial movement, without restraint, by the arresting cables 30 is parallel to the ground and is designed into the arresting system and provided by the position of the loops of the restraining cables 40 as disposed around the arrestor cables 30. This allows the arrestor cables 30 to fully envelop the front of the vehicle 90 before they can be pulled down to the ground. This feature of the system prevents the intruding vehicle 90 from being able to run over the top of the arrestor cables 30.

The arresting cables wrap 30 around the front of the vehicle 90 typically catching the engine and frame in a web of horizontal cables. As the arrestor cables 30 are moved by the vehicle impact further away from the fence line, the restraint cables 40 on either side of the vehicle 90 through which the arrestor cables 30 are looped are dragged horizontally away from their original support position. See FIGS. 6C and 7C. As these restraint cables 40 move from their "at rest" position they begin to exert restraining force on the arrestor cables 30.

The arrestor cables bend around the restraint cable loops, which now begin acting as virtual pulleys as they re-shape the arrestor cables 30. The force of the vehicle impact is now transmitted laterally along the arrestor cables to the anchor columns 20A, 20B at each end. Because the anchor columns 20A, 20B are designed to be virtually non-movable within the limits of the calculated design forces, the energy of the attacking vehicle 90 is absorbed by the elastic deformation of the arrestor cables 30. In this regard, the movable connection of restraint cable loops to the horizontal cables allows for the impact force of the vehicle to be spread over the entire length of the cables 30 as opposed to a rigid connection that may concentrate the impact force over a relatively short span of the horizontal cables, which may result in cable failure. The restraint cables 40 provide the geometry required by the system to direct the restraining forces along the arrestor cables 30 and to limit the travel of the vehicle 90 beyond the perimeter fence line. See FIGS. 6D and 7D. Without this geometry the vehicle 90 may travel too far into the protected area.

The fence portion of the system can be configured to meet a variety of requirements for stopping a vehicle intruding into a secured area through a perimeter fence line. The system design is such that varying the number and location of arrestor cables and restraint cables in accordance with the geometric rules of the system will provide sufficient restraining force to stop a variety of vehicles at various speeds. For instance to meet one Federal Government requirement for perimeter fence security requires a 15,000-pound vehicle traveling at 30-mph to stop within a distance of less than 10-feet inside the fence line. The geometry of the passive system provided by the virtual pulley restraint cables allows the system to be configured to stop a vehicle in such a prescribed distance.

The active portion of the system 100 utilizes a collapsible surface to prevent entry of an intruding vehicle into a secured area through a gate access point. See FIG. 8. The system 100 does not require hydraulic or electrical means to deploy and is mechanically activated by the intruding vehicle. The boundaries of the active system 100 may be adjacent to the terminating anchor posts of sections of the passive system 10 (e.g., disposed on either side of the gate access opening). The active system 100 uses gravity and the mass of an intruding vehicle 90 to achieve the stopping action. FIGS. 9A-9E. In one embodiment, the system 100 is an architecturally hidden structure that presents the appearance of a flat road section formed of, for example, perforated steel plates such as is commonly seen on bridge decks.

Generally, the system 100 utilizes a section of road surface/deck 110 consisting of structural steel members and deck plates, e.g. perforated steel, suspended over a pit 120 under the road level. The pit 120, which may be wedge shaped, may have a shallow end located at the initial attack end of the deck 110 of the active system. The deck 110 includes a hinged connection 112 at the attack end of the pit 120 such that, when activated, the hinged end (i.e., attack end) of the deck 110 remains at the original level while the deck 110 rotates and the other end (i.e., secured end) drops into the pit 120. The deck 110 is initially suspended over the pit 120 by movable supports 130. In one exemplary embodiment the supports 130 are pins located at intervals along the sides of the deck 110 and extending into mating apertures along the top edge of the pit 120 (or vice versa).

The movable pin supports are attached to an actuator system 150 via one or more cables and pulleys or rods, clevis pins and levers which are triggered by a vehicle hitting a barricade arm 160 of the actuator system. Generally, the barricade arm may be disposed across the opening of the access gate. When an intruding vehicle 90 impacts the barricade arm 160 (see FIG. 9B) the rotating motion of the arm 160 is translated by, for example, supporting posts and is transmitted through the actuator system 150 to move the moveable supports 130 from beneath the deck 110, for example to pull movable pins out of mating apertures along the top edge of the pit 120 thereby allowing the secured end of the pivoting road deck 110 to drop into the pit 120. The use of multiple pins deployed along each edge of the road deck spreads the supporting loads and reduces the support pin withdrawal forces. The intruding vehicle 90 continues past the rotated barricade arm 160 onto the now unsupported road deck 110 and falls down with the road deck 110 into the pit 120. See FIGS. 9C and 9D. Finally, the vehicle 90 will reach the vertical reinforced end wall 180 at the end of the pit 120 where it will be stopped. See FIG. 9E. It should be noted that the deck 110 may be designed in relation to the top expected speed of an intruding vehicle. For instance, a faster vehicle typically requires a longer road deck. For example a 60 mph vehicle speed may require a 50 ft long deck that falls whereas a 40 mph vehicle speed may require 32 ft long deck that falls 5 ft, etc. Further, it will be appreciated that barriers prior to the road deck may be utilized to limit the speed of an approaching vehicle.

After actuation, the road deck 110 and vehicle 90 will fall a vertical distance at a consistent rate determined by the acceleration due to gravity. The horizontal length of the anti-ram gate protection system road deck is determined by the maximum speed of the vehicle to be stopped, such that the intruding vehicle will have fallen preferably at least about five feet over the aforementioned horizontal road deck distance after triggering collapse of the road deck.

After hitting the end wall 180 the intruding vehicle 90 may be disabled or destroyed or at the very least unable to proceed into the secured area. The higher the vehicle speed, the more damage imparted to the vehicle. The end wall may be made from any appropriate material, for example reinforced concrete backed by compacted fill under the continuing roadbed. The end wall 180 is designed to be virtually undamaged after stopping an attacking vehicle. The road deck is also constructed such that it typically remains undamaged. Accordingly, the vehicle wreckage can then be removed and the road deck may be lifted back into place and the actuating mechanism may be reset such that the access gate protection system is ready for the next attempted intrusion.

The active and passive portions of the systems discussed above are designed to be installed as part of a variety of fence designs and perimeter configurations. In various configurations, these components are unobtrusive and can blend with the aesthetics of the perimeter surroundings while providing anti-ram protection along all or portions of a secured perimeter. The active portion of the system can be configured to suit any gate width and to architecturally blend into any road surface. Both passive and active portions of the system are scaleable to suit any size and speed of attack vehicle.

The invention claimed is:

1. A system for arresting an impact of a vehicle attempting to cross a perimeter incorporating the system, comprising:

first and second anchor columns, the anchor columns being spaced apart and secured below grade;

at least one horizontal cable extending between the anchor columns, wherein ends of each the horizontal cable are affixed to the anchor columns;

at least one support post disposed between the anchor columns, wherein the support post supports the at least one horizontal cable above grade; and an anchor cable secured below grade and having first and second free ends above grade, wherein at least one free end is movably connected to the horizontal cable at a location between the first and second anchor columns, wherein a mid section of the anchor cable between the first and second free ends is securely anchored below grade and where the first end form a first loop and the second end forms a second loop, wherein said at least one horizontal cable passes through at least one of said first and second loops.

2. The system of claim 1, wherein the anchor cable is disposed within the support post.

3. The system of claim 2, wherein the support post includes a recessed channel along at least a portion of its height, wherein the anchor cable is seated in the recessed channel and may move out of the recessed channel upon a vehicle impacting the horizontal cable.

4. The system of claim 1, wherein the free end defines a loop and wherein the horizontal cable passes through the loop.

5. The system of claim 1, wherein at least two horizontal cables extend between the first and second anchor columns, wherein at least one horizontal cable extends through the first loop and at least one horizontal cable extends through the second loop.

6. The system of claim 5, wherein at least first and second horizontal cables are at different heights.

7. The system of claim 1, wherein the support post further comprises:

at least one horizontal notch for receiving the at least one horizontal cable.

8. The system of claim 1, further comprising:

a plurality of support posts and a plurality of anchor cables disposed between the anchor columns.

9. The system of claim 8, wherein a spacing between the anchor cables is no greater than about 20 feet.

10. The system of claim 1, wherein the horizontal cables are housed within horizontal fencing components that extend between vertical uprights.

* * * * *

UNITED STATES PATENT AND TRADEMARK OFFICE

CERTIFICATE OF CORRECTION

PATENT NO. : 7,794,172 B2
APPLICATION NO. : 11/877237
DATED : September 14, 2010
INVENTOR(S) : Winkler et al.

It is certified that error appears in the above-identified patent and that said Letters Patent is hereby corrected as shown below:

Column 10, line 8, after "ends", insert --extending--.

Signed and Sealed this

Ninth Day of November, 2010

David J. Kappos

David J. Kappos
*Director of the United States Patent and Trademark Office*